United States Patent [19]

Frascaroli et al.

[11] Patent Number: 4,562,986

[45] Date of Patent: Jan. 7, 1986

[54] SUPPORT FOOT FOR FURNITURE, IN PARTICULAR OFFICE FURNITURE

[75] Inventors: Francesco Frascaroli, Bologna; Carlo Biondi, S.Giovanni in Persiceto, both of Italy

[73] Assignee: C.O.M. Cooperativa Operai Metallurgici S.C.R.L., Bologna, Italy

[21] Appl. No.: 601,852

[22] Filed: Apr. 18, 1984

[30] Foreign Application Priority Data

Apr. 22, 1983 [IT] Italy ..... 4848/83[U]

[51] Int. Cl.[4] ..... F16M 11/20

[52] U.S. Cl. ..... 248/188.1; 248/188.7

[58] Field of Search ..... 248/188.1, 676, 165, 248/188.7; 108/153, 150, 157, 158, 154, 155; 403/205, 231, 403

[56] References Cited

U.S. PATENT DOCUMENTS

| | | | |
|---|---|---|---|
| 331,212 | 11/1885 | Pleukharp | 108/150 |
| 926,097 | 6/1909 | Carl et al. | 108/150 |
| 1,527,094 | 2/1925 | Tomlinson | 108/154 |
| 1,935,682 | 11/1933 | Wege | 108/150 |
| 2,910,803 | 11/1959 | Close | 248/188.1 X |
| 3,568,967 | 3/1971 | Furtak | 248/188.1 |
| 3,635,174 | 1/1972 | Ball | 108/150 |
| 3,655,159 | 4/1972 | Held | 248/188.1 |
| 3,742,871 | 7/1973 | Kienel | 108/150 |
| 3,756,169 | 9/1973 | Dybvig | 108/150 |
| 3,866,550 | 2/1975 | Geschwender | 108/153 |
| 4,043,278 | 8/1977 | Kessler | 108/150 |
| 4,117,784 | 10/1978 | Piretti | 248/188 X |
| 4,385,850 | 5/1983 | Bobath | 403/403 X |

FOREIGN PATENT DOCUMENTS

| | | | |
|---|---|---|---|
| 2546765 | 10/1975 | Fed. Rep. of Germany | 108/150 |

*Primary Examiner*—J. Franklin Foss

*Attorney, Agent, or Firm*—Fuller, House & Hohenfeldt

[57] ABSTRACT

A support foot for furniture, in particular office furniture, having an internal frame and a cover extending about the internal frame, the internal frame being formed by releasably connecting together a base (2), an upright (21) and a top piece (25), and the base (2) and the piece (25) clamping therebetween two lateral elements (44) to which the cover is connected.

7 Claims, 4 Drawing Figures

SUPPORT FOOT FOR FURNITURE, IN PARTICULAR OFFICE FURNITURE

The present invention relates to a support foot for furniture, in particular office furniture where said foot is intended to support a desk work surface directly or a bar to which said desk work surface is connected.

It is an object of the present invention to provide a support foot designed so as to allow passage therealong of wires and cables for the electrical power and control services, thus eliminating wires dangling over the edges of the work surfaces.

It is another object of the present invention to provide a support foot designed so that its external shape and size may be easily varied.

It is a further object of the present invention to provide a support foot which may be very easily assembled or disassembled so as to keep down the assembling costs and to make it easy to inspect the aforementioned wires and cables.

It is a still further object of the present invention to provide a foot which is cheap and easy to manufacture.

According to the present invention there is provided a support foot for furniture, in particular office furniture, having a frame comprising a base, a top piece, a central upright extending between said base and said top piece, and two lateral elements arranged on opposite sides of, and substantially parallel to, said upright; both said base and said top piece being connected to said two lateral elements by means of axially disengageable coupling means, and screw means being provided extending through said base, said upright and said top piece to hold said internal frame together.

The invention will be described by way of example with reference to the accompanying drawings, in which.

Figure 1:
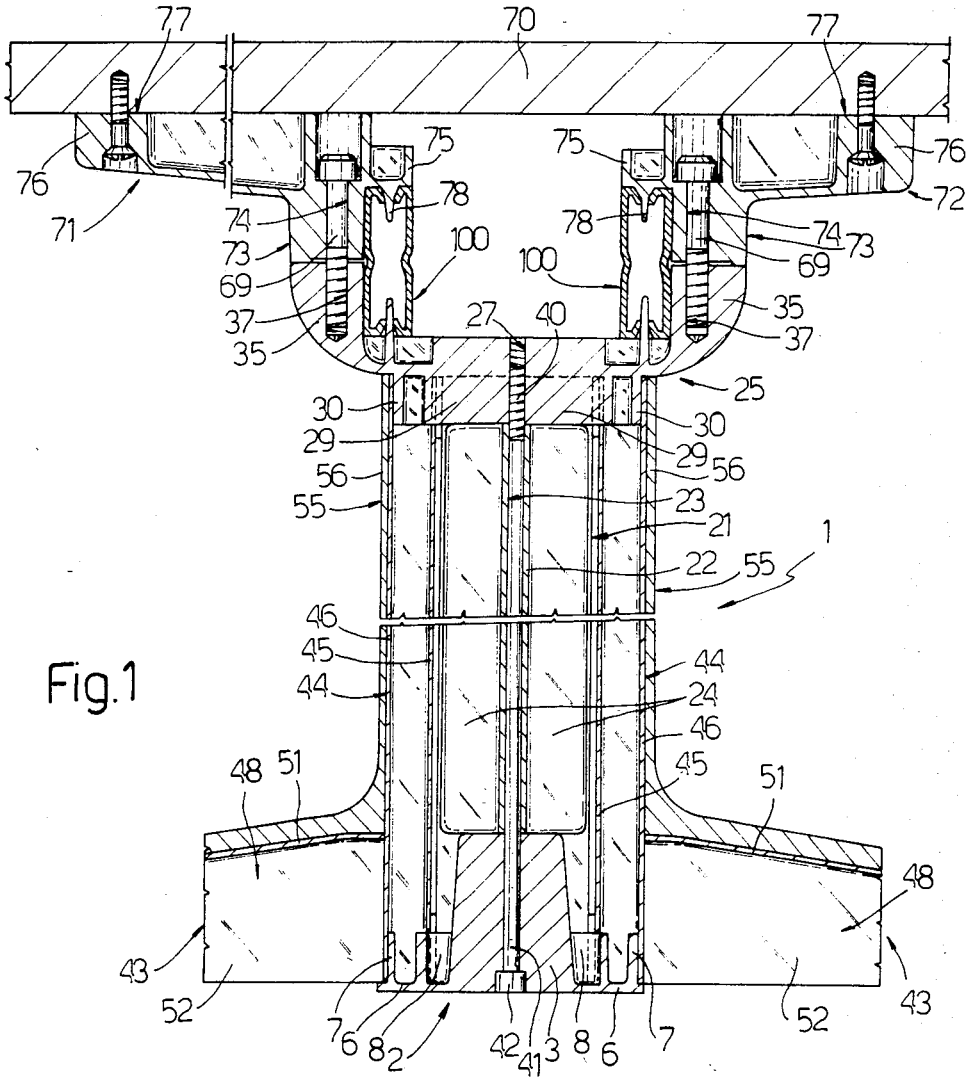
FIG. 1 is a sectional view of a support foot in accordance with the present invention.
Figure 2:
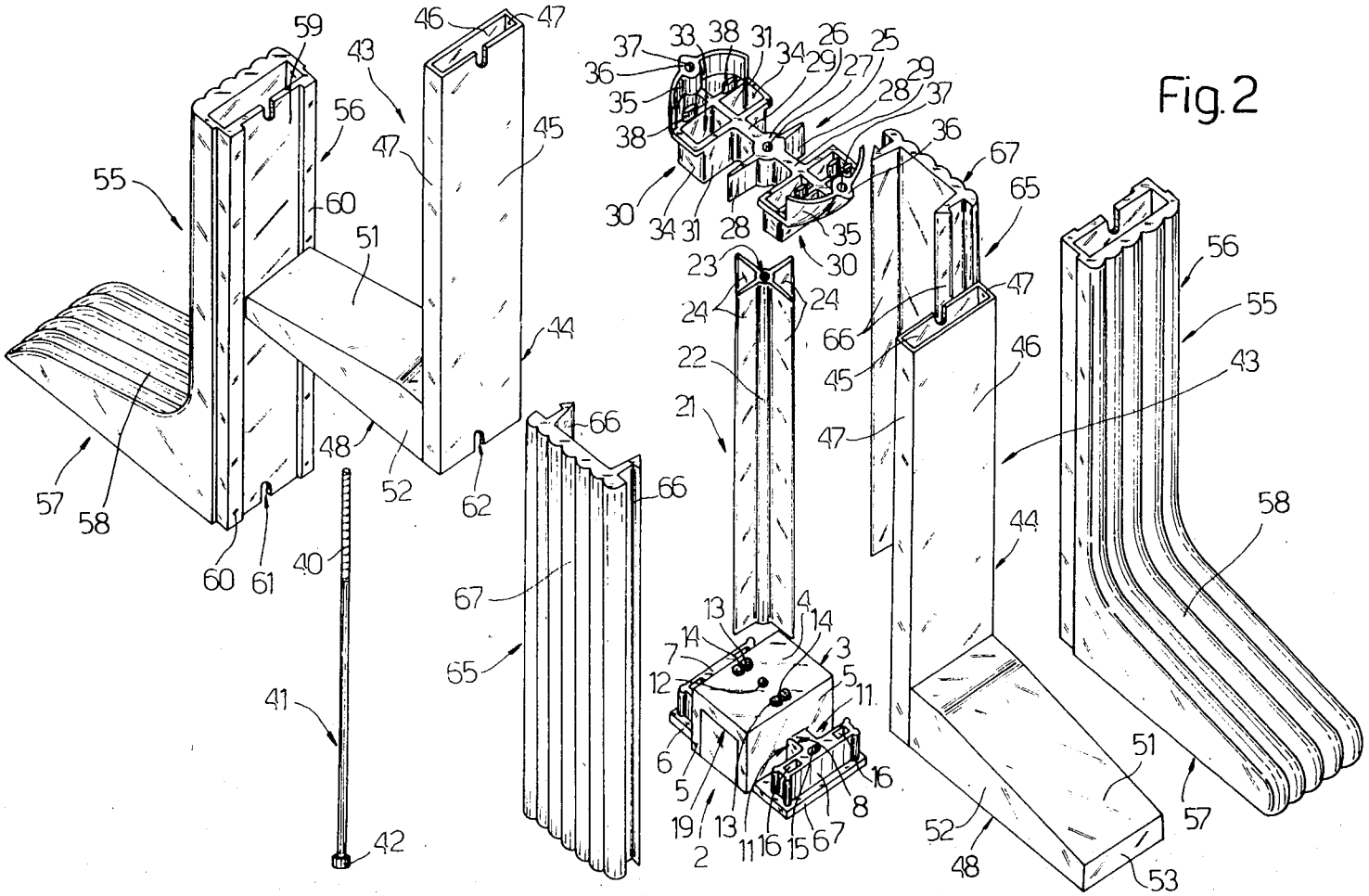
FIG. 2 shows an exploded view in perspective of the foot of FIG. 1.

In FIG. 1 a support foot 1 is shown which is particularly suitable for office furniture and is designed to support either a work surface of said office furniture or bars supporting said work surfaces. Foot 1 comprises a base 2 having an essentially prismatic centre portion 3 with a bottom panel which, in use, rests on the floor, a top panel 4 and four side panels 5. From two opposite side panels 5, two plates 6 extend which are parallel to and in contact with the floor. From each plate 6 an essentially prismatic body 7 extends upwards which is shorter in height than the centre portion 3. Each body 7 is connected to its respective side panel 5 by a central rib 8 defining two aligned slots 11 extending between body 7 and the facing panel 5. Centre portion 3 is provided with an axial vertical through hole 12. Top panel 4 is provided with two vertical extensions 13 arranged on opposite sides of hole 12 and each having an upper groove 14. Each body 7 is provided with a central vertical threaded through hole 15 and two lateral weight-reducing cut-outs 16. On side panels 5 not connected to ribs 8, provision is made for an essentially rectangular, dovetail recess 19. Base 2 is preferably made of aluminium and usually cast in one piece.

Base 2 supports an upright 21 comprising a central tubular portion 22 having an axial through hole 23 coaxial with hole 12, and four fins 24 extending radially from portion 22 and defining four separate channels extending between base 2 and a top piece 25 supported by upright 21. Top piece 25 comprises a cylindrical centre portion 26 having a threaded through hole 27 coaxial with hole 23, and four fins 28, 29 extending radially from said portion 26 in the same plane as fins 24. Two co-planar fins 29 extend each through a respective cup-shaped hollow body 30 having lateral walls 31 and 34 perpendicular and parallel respectively to the relevant fin 29 and an internal cavity 33 open upwards. The end of each fin 29 is connected to a plate 35 bent essentially to form an arc of a circle and having its concave side facing towards the opposite plate 35. Each plate 35 extends above the respective body 30 and is provided with a thicker centre portion 36 and a threaded central dead hole 37. Each of the outermost walls 31 is provided with a pair of slightly tapered tabs 38 extending upwards.

Base 2, upright 21 and top piece 25 are secured to one another by a screw 41 comprising a lower head 42 and a threaded stem 40, and engaging holes 12, 23 and 27. Moreover, the bottom edges of two co-planar fins 24 engage with grooves 14, and fins 29 are co-planar with ribs 8.

The unit comprising base 2, upright 21 and top piece 25 is fitted with two L-shaped elements 43 each comprising a hollow vertical portion 44 of rectangular cross-section having an internal plate 45, an external plate 46 and two lateral plates 47. Each element 43 further comprises a horizontal portion 48 extending outwards from the lower end of portion 44 and including an upper plate 51, two lateral outwardly tapered side plates 52 and an external plate 53.

The unit 2-21-25 mentioned above defines, together with element 43, and in particular together with hollow vertical portions 44, a frame which is provided with an external cover comprising two cover elements 55, preferably made of plastics, each having substantially the same shape as element 43 and comprising a vertical hollow portion 56 accommodating a vertical portion 44, and a lower horizontal portion 57 covering a horizontal portion 48. Each cover element 55 has an external L-shaped surface 58 of any suitable design, and an internal vertical surface 59, which is provided with two peripheral longitudinal vertical ribs 60, and with a lower central recess 61 coinciding with a corresponding recess 62 provided centrally at the lower edge of the relevant plate 45.

Foot 1 can be assembled very easily. All that is required is to assemble the unit consisting of base 2, upright 21 and top piece 25, as already described, but without tightening screw 41 so as to enable the two elements 43 each fitted with the respective cover element 55 to be assembled facing each other on base 2. To do this, each element 43 is simply slid downwards so as to engage its recess 62 with its respective rib 8 and to accommodate its respective bodies 7 and 30. Bodies 7 and 30 engage the respective open ends of portions 44 and act as pins of a pin-and-socket joint to connect elements 43 to the aforementioned unit 2-21-25. Then, by tightening screw 41, the two elements 43 are secured firmly between base 2 and top piece 25.

As shown in FIG. 1, the cover mentioned hereinabove further comprises two essentially flat cover elements 65 having an external surface 67 of any suitable design and assembled facing each other between the two elements 43. The inner face of each element 65 is provided with two toothed longitudinal vertical tabs 66, each of which snap-engages a respective rib 60.

Upright 21 and fins 28 and 29 on top piece 25 define four channels for accommodating electric cables for such functions as supplying lighting, electronic computers, calculating machines, typewriters, etc. and, at the same time, for accommodating telephone, telecommunication or other types of cables which, to operate properly, are usually to be housed in separate channels from electricity supply cables. The said electric and other types of cables are threaded inside foot 1 through holes or openings (not shown) at the bottom of parts 65 and out of foot 1 through top piece 25 from where they are run through the bar supporting the work tops or through raceways provided along the said work tops.

Figures 3, 4:
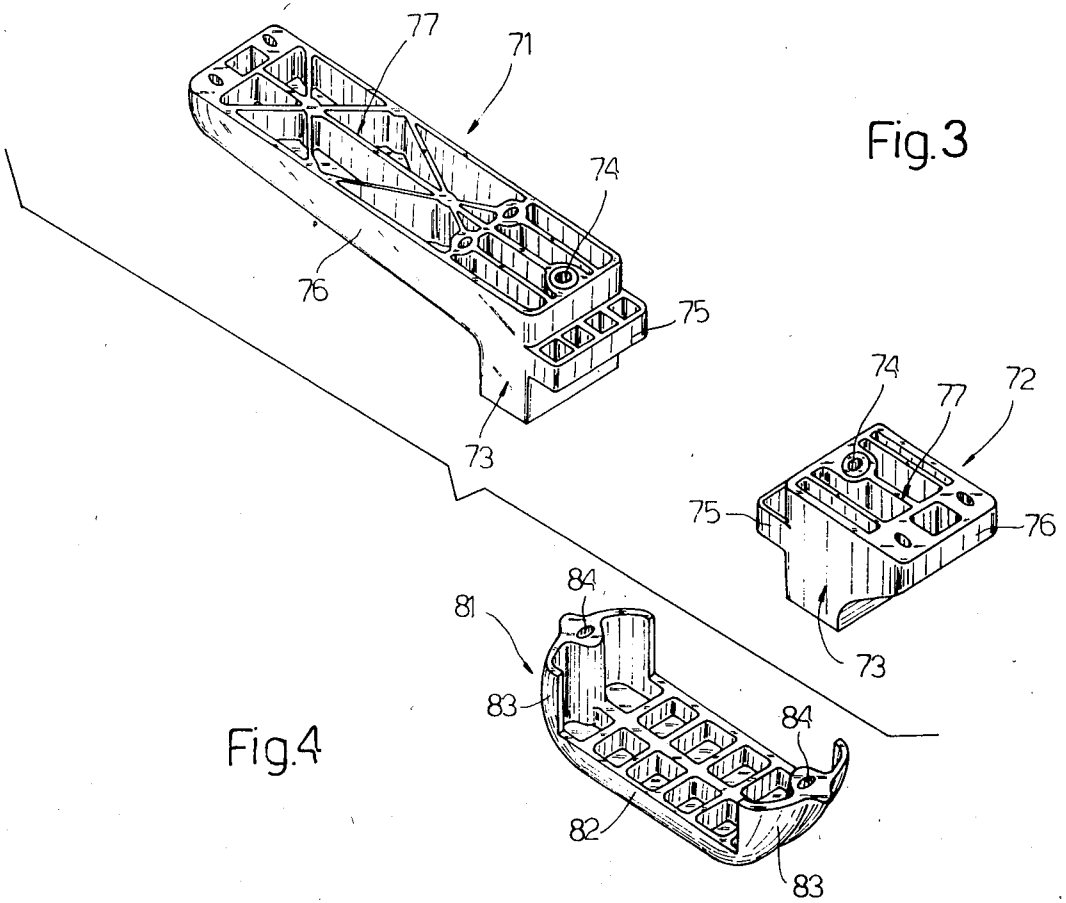
FIG. 3 is a perspective view of a pair of brackets for supporting work tops.
FIG. 4 is a perspective view of a clamp which may be assembled on the stand for supporting bars supporting the said work tops.

FIG. 3 shows two brackets 71 and 72 preferably made of metal and adapted to be secured to top piece 25 to define a support surface for at least one work surface 70. In particular, brackets 71 and 72, the first of which is longer than the second, may be used together to support either a single work surface (70) or respective work surfaces. Alternatively, each bracket 71 or 72 may be replaced for the same purposes by a bracket equal to the other.

As shown in FIG. 3, each bracket 71,72 comprises a central portion 73 provided with a vertical through hole 74 coaxial with a respective hole 37 for connection of bracket 71,72 to top piece 25 by means of a screw (69).

Each central portion 73 is provided with two lateral opposite horizontal arms 76 and 75, the first of which has an upper flat surface 77 adapted to be arranged in contact with the aforementioned work surface (70), and the second of which is provided with downwardly extending tabs 78 facing respective tabs 38 and similar thereto.

The two arms 75 define, together with top piece 25, a horizontal passage substantially rectangular in cross-section, through which a horizontal bar (100) may be mounted and fixed by means of tabs 38 and 78. The above bar is intended to support one or more work surfaces (not shown) or any other type of office furniture (not shown).

If foot 1 is intended to support the aforementioned horizontal bar (100) only, brackets 71 and 72 are replaced by a U-shaped element 81 shown upside-down in FIG. 4 and comprising a central horizontal panel 82 and two side panels 83. Side panels 83 are shaped as plates 35 and are each provided with a vertical through hole 84 coaxial with a respective hole 37 for connection of element 81 to top piece 25 by means of screws.

From the above description it is possible to see that one of the main features of foot 1 consists in vertical portions 44 of elements 43. These portions 44 define, in fact, together with base 2, top piece 25, upright 21 and screw 41, an internal frame supporting all the external structure of foot 1, and make it possible to easily change the external configuration of foot 1. A first change could be that of eliminating one or both horizontal portions 48, which have substantially no structural importance, and replace cover elements 55 with cover elements (not shown) with no lower horizontal portion 57. A second change could be that of replacing one or both elements 65 with cover elements (not shown) having a lower horizontal portion similar to portion 57.

From the above it results that the external configuration of foot 1 may very easily vary between a straight-pedestal configuration to a configuration having four lower horizontal extensions without changing the internal structure, but by simply varying the shape of four cover elements generally made of plastics, the external surface of which may be designed according to any suitable design.

We claim:

1. A support foot for furniture, in particular office furniture, having a frame comprising:

a. a base having a prismatic center portion defining a top panel and a pair of first couplings oppositely spaced from the central portion, each coupling being connected to the central portion by a transverse rib to form two aligned slots between the coupling and central portion;

b. a top piece having a central portion defining a bottom panel and first and second pairs of fins extending radially from the central portion, the fins of the first pair extending in opposite directions through respective second couplings aligned with the base couplings, the first pair of fins terminating in respective plates that extend above the second couplings;

c. a central upright extending between the base top panel and top piece bottom panel ;

d. a pair of lateral elements spaced transversely from the base central portion and arranged on opposite sides of and substantially parallel to the upright, the lateral elements being disengageably connected to the base and top piece by means of the aligned pairs of first and second couplings; and e. screw means extending through the base, upright, and top piece for holding the internal frame together.

2. The support foot of claim 1 wherein the first and second couplings are formed as rectangular prismatic bodies extending upwardly from the base and downwardly from the top piece, respectively, and wherein the lateral elements are formed as rectangular tubes having walls adapted to slidingly engage and substantially surround the peripheries of the prismatic bodies and to extend into the base aligned slots to connect the lateral elements to the base and top piece.

3. The support foot of claim 2 further comprising:

a. a pair of first covers of generally the same shape as the lateral elements, each first cover defining a vertical rectangular opening therethrough to receive a rectangular lateral element therein for covering the lateral element; and b. a pair of opposed second covers extending between and connected to the first covers to cooperate therewith for enclosing the upright.

4. The support foot of claim 3 wherein:

a. the first covers are formed with vertically extending ribs near the longitudinal margins thereof; and b. the second covers are formed with vertically extending toothed tabs adapted to resiliently engage the first cover ribs, so that the first and second covers cooperate to snap-connect to each other.

5. The support foot of claim 3 wherein the upright is formed with a central tubular portion and a plurality of fins extending radially from the central portion and aligned with the first and second pairs of fins on the top piece, the upright fins terminating proximate the first and second covers, so that the upright and top piece fins and first and second covers cooperate to form a plurality of enclosed vertical passages through the support foot.

6. The support foot of claim 1 further comprising a pair of oppositely extending horizontal work surface support brackets, each surface support bracket having a central portion defining a lower surface supported by and releasably fastened to a top piece plate and an arm extending outwardly from the central portion to support the work surface.

7. The support foot of claim 6 wherein each surface support bracket further comprises a pair of arms extending inwardly from the central portion above the central portion lower surface to create a pair of facing inner walls on the bracket central portion, the top piece central portion and plates and the bracket inner walls and inwardly extending arms cooperating to define a horizontal passage of substantially rectangular cross section.

* * * * *